US007572192B1

(12) United States Patent
Boyd

(10) Patent No.: US 7,572,192 B1
(45) Date of Patent: Aug. 11, 2009

(54) GOLF SWING TRAINING AID

(76) Inventor: Richard L. Boyd, 22661 Port Gamble Rd., Poulsbo, WA (US) 98370

( * ) Notice: Subject to any disclaimer, the term of this patent is extended or adjusted under 35 U.S.C. 154(b) by 470 days.

(21) Appl. No.: 11/479,887

(22) Filed: Jun. 30, 2006

(51) Int. Cl.
*A63B 69/36* (2006.01)

(52) U.S. Cl. ..... 473/274; 473/208

(58) Field of Classification Search ..... 473/274, 473/207, 208, 268; 294/19.1
See application file for complete search history.

(56) References Cited

U.S. PATENT DOCUMENTS

| | | | | | |
|---|---|---|---|---|---|
| 1,459,705 | A | * | 6/1923 | Bullock | 473/208 |
| 3,243,186 | A | * | 3/1966 | Johnson | 473/274 |
| 3,325,169 | A | * | 6/1967 | Mackniesh | 473/140 |
| 3,397,892 | A | * | 8/1968 | Stahl | 473/276 |
| 3,408,078 | A | * | 10/1968 | Falerni et al. | 473/208 |
| 3,443,811 | A | * | 5/1969 | Brooks | 473/274 |
| 3,712,625 | A | * | 1/1973 | Taylor | 473/274 |
| 4,302,014 | A | * | 11/1981 | Shull | 473/274 |
| 4,513,972 | A | * | 4/1985 | Empie | 473/274 |
| 4,789,159 | A | | 12/1988 | Kane | |
| 5,039,105 | A | * | 8/1991 | Ro | 473/258 |
| 5,253,870 | A | | 10/1993 | Bedney | |
| 5,348,304 | A | | 9/1994 | Meade | |
| 5,439,226 | A | * | 8/1995 | Luedtke | 473/232 |
| 5,560,607 | A | | 10/1996 | Macroglou | |
| 5,577,729 | A | * | 11/1996 | Sabour | 473/274 |
| 5,769,734 | A | | 6/1998 | Qualey, Sr. | |
| 5,879,239 | A | | 3/1999 | Macroglou | |
| 6,390,823 | B1 | | 5/2002 | Wesenhagen | |
| 6,843,731 | B1 | | 1/2005 | Oprandi | |
| 7,204,766 | B1 | * | 4/2007 | Rose et al. | 473/274 |

* cited by examiner

*Primary Examiner*—Raleigh W. Chiu
(74) *Attorney, Agent, or Firm*—Robert C. Montgomery

(57) ABSTRACT

The present invention aids golfers in developing a better golf swing in a quick, easy and effective manner, comprising a "C"-shaped head rest that is positioned across the user's forehead and padded for comfort. The headrest is connected to an extendable shaft that varies in length from 4 feet long to 7 feet long. To use the apparatus, the user or a golf trainer would first position the user in a proper swing stance. Next, the apparatus is placed between the user's forehead and the ground at an outward angle. At this point the user completes his or her golf swing. If their head should stay properly positioned, the apparatus remains in place. If their head should move, the apparatus will fall away to the ground. After a period of time and repeated use, the user will be trained to maintain a proper head position at all times, even when the apparatus is not being utilized.

8 Claims, 5 Drawing Sheets

GOLF SWING TRAINING AID

RELATED APPLICATIONS

The present invention was first described in Disclosure Document No. 579,765 filed on Jun. 9, 2005.

FIELD OF THE INVENTION

The present invention relates generally to an apparatus that trains a golfer to keep his or her head in the proper position throughout a golf swing.

BACKGROUND OF THE INVENTION

The game of golf has become one the most technologically advanced sports in the world today. Experts in science and physics have combined state of the art materials with ergonomic and aerodynamic principles in order to produce golf clubs and golf balls that produce more accurate and consistently longer golf shots. As a result of the highly competitive nature of the golf equipment business, most of the big name manufacturers are continuously looking for equipment and devices that will improve a golfer's game. Thus, there is a continual need for new and innovative golf equipment that will help golfers improve their skills with the numerous types of golf swings.

Several attempts have been made in the past to assist golfers in practicing the proper stance and hitting technique required for enjoying the game of golf. U.S. Pat. No. 4,789,159 in the name of Kane discloses an apparatus for assisting a golfer to keep the golfer's head level with the ball and still while the golfer is in the process of hitting the ball. The Kane device consists of a pair of frame members that rest on the golfer's ears and worn such that it rests in front of the golfer above or below the line of sight between the golfer's eyes and the golf ball. The present invention utilizes a telescoping pole supported on the ground and the user's head and thus presents a more controlled and stable training method.

U.S. Pat. No. 5,769,734 issued in the name of Qualey, Sr. describes a golf swing training device for attachment to a golf club involving a bell-shaped weight attached and suspended from a elastic cord for attachment to the shaft of a golf club. This Qualey, Sr. device is a weight that is attachable to a golf club as opposed to a body-supporting device as in the present invention and therefore differs greatly.

U.S. Pat. No. 5,348,304 issued in the name of Meade discloses a golf club swing training method providing a ground resting planar reflecting surface enabling the golfer to analyze their swing while performing said swing. The Meade design involves the use of a mirror to analyze one's swing and doesn't perform any physical action to correct an incorrect golf swing as in the present invention.

U.S. Pat. No. 6,390,823 issued in the name of Wesenhagen describes a golf alignment trainer consisting of a visor with a low powered lens attached to the center of the visor with alignment markings through which one views the golf ball target. This device must be worn on the head of the user and doesn't take into account proper balance and merely teaches one the proper head positioning and focusing on the target golf ball instead of an entire hitting technique.

U.S. Pat. No. 5,879,239 issued in the name of Macroglou discloses an alignment device and method for aligning for achieving a proper golf stroke involving a light source attached to a support member to be worn by a user about the head. The light source emits a linear beam of light parallel to the user's body to assist in training the proper standing and focusing techniques prior to hitting a golf ball. This device utilizes a light source which must be powered to function whereas the present invention does not have parts that require electrical power to function properly. U.S. Pat. No. 5,560,607, also issued in the name of Macroglou describes a similar device utilizing a mirror assembly in place of a light source.

U.S. Pat. No. 5,253,870 issued in the name of Bedney golf practicing device with a head motion detector. Again, along with the previously mentioned prior art, the present invention does not have multiple and complicated moving parts and devices that require electrical power to operate and thus does not fall under the scope of the Bedney design.

U.S. Pat. No. 6,843,731 issued in the name of Oprandi discloses an a golf club swinging guide releasably attachable to a lower end of a golf shaft, consisting of a stationary member aligned to the intended line of flight, a movable member, and a wind vane. This devices attaches to the shaft of the club as opposed to an adjustable pole supported by a user's head as in the present invention.

None of the prior art particularly describes a telescopic pole with a head supporting member to properly align a golfer during the act of striking a golf ball. Accordingly, there is a need for a means by which the proper act of striking a golf ball can be accomplished by a simple, easy-to-use, and lightweight apparatus that can be easily transported and stored when not in use.

SUMMARY OF THE INVENTION

In view of the foregoing disadvantages inherent in the prior art, it has been observed that there is need of a device to properly align one's body during the act of striking a golf ball with a golf club.

It has further been observed that there is a need for a device that is easily extendable and retractable according to the dimensions of the user.

It has been further observed that there is a need for a device that is easily manipulated and used without any external power sources or extraneous attachments and is readily mastered by a novice or experienced golfer.

The object of the present invention is to provide a device to properly align a golfer's stance when striking the golf ball in the form of a ground-supported pole with a "C"-shaped head supporting member at its upper end and a base plate at its bottom end.

Another object of the present invention is to provide a "C"-shaped head supporting member with an upper and lower portion for supporting the user's crown and forehead comfortably and maintain head position relative to the striking target.

A further object of the present invention is to provide a telescoping pole for providing greater adjustability depending on the height of the user and individual striking stances.

Still another object of the present invention is to provide a pivoting base plate on the bottom of the pole for contacting the ground surface to enable the user to practice their golf swing while supported by the training device.

Yet still another object of the present invention provides for anchoring means for maintaining the position of the base plate and hence the device throughout the user's swing.

To achieve the above and other objectives, the present invention provides for a device that trains a novice or experienced golfer the proper and correct golfing stance, alignment, and balance prior to and during the act of swinging a golf club and striking a golf ball. To achieve this goal, the user rests their head within the "C"-shaped head supporting member, places the base plate on the ground surface directly in front of the user and appreciatively outside of the intended golf swing path, securing or anchoring the base plate as needed, and adjusting the telescoping pole as needed to accommodate the user's height and securing with a thumb screw. The present invention is intended for use with both right-handed and left-handed golf swings.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
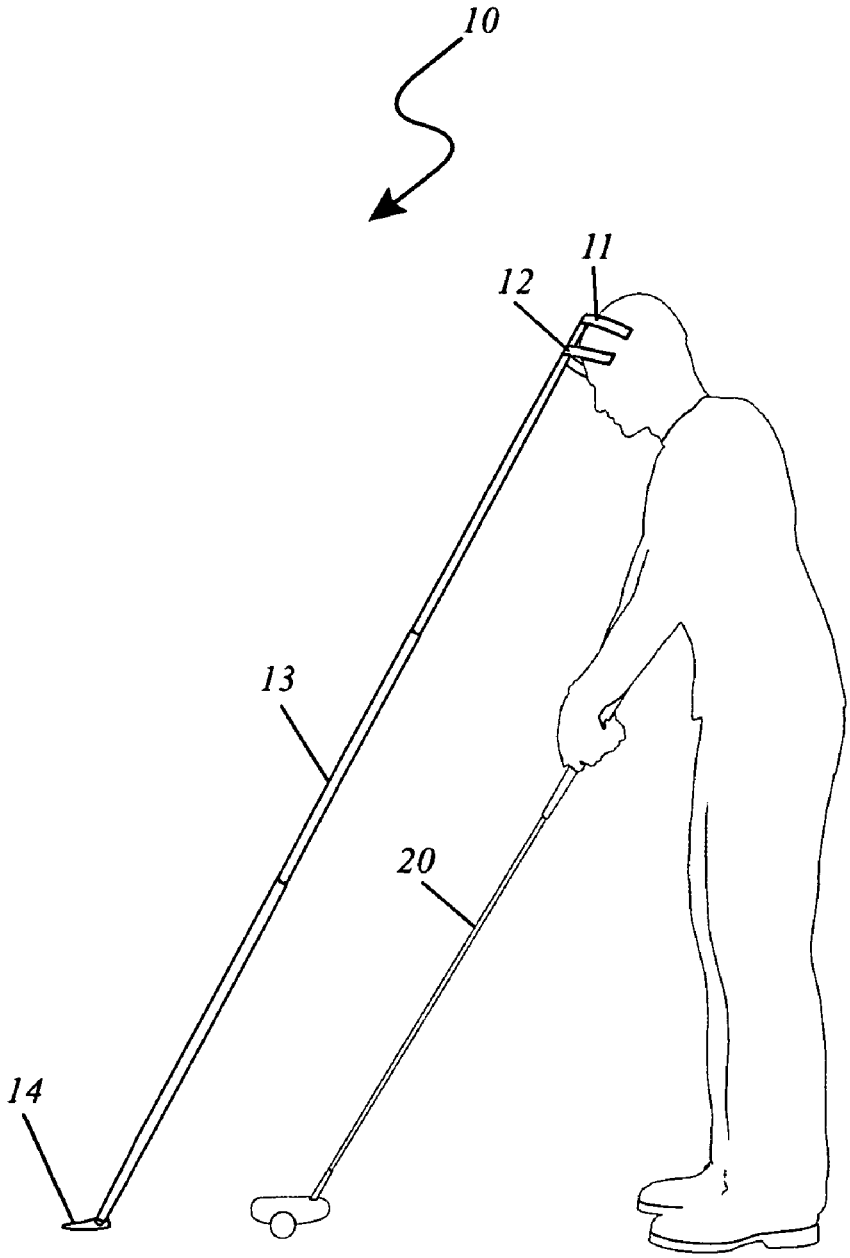
FIG. 1 is a perspective view of the golf swing training aid device 10 incorporated into a golf swing training system defined by the present application; and, FIG. 2 is a side perspective view of the upper head rest 11 and the lower head rest 12 mounted on the extendable shaft 13, according to a preferred embodiment of the present invention; and, FIG. 3 is the opposing side perspective view of the upper head rest 11 and the lower head rest 12 mounted on the extendable shaft 13, according to a preferred embodiment of the present invention; and, FIG. 4 is a back perspective view of the upper head rest 11 and the lower head rest 12 mounted on the extendable shaft 13, according to a preferred embodiment of the present invention; and, FIG. 5 is a perspective view of the shaft 13 attached therein the base plate 14, according to a preferred embodiment of the present invention.

10 golf swing training device
11 upper head rest
12 lower head rest
13 extendable shaft
14 base plate
15 rounded bottom
30 golf club

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an apparatus and method for assisting in the proper swinging methods of a golf club 20. The golf swing training aid device 10 (herein described as the "apparatus") comprises an extendable shaft mechanism, base plate foot assembly, and a head rest assembly.

Figure 2:
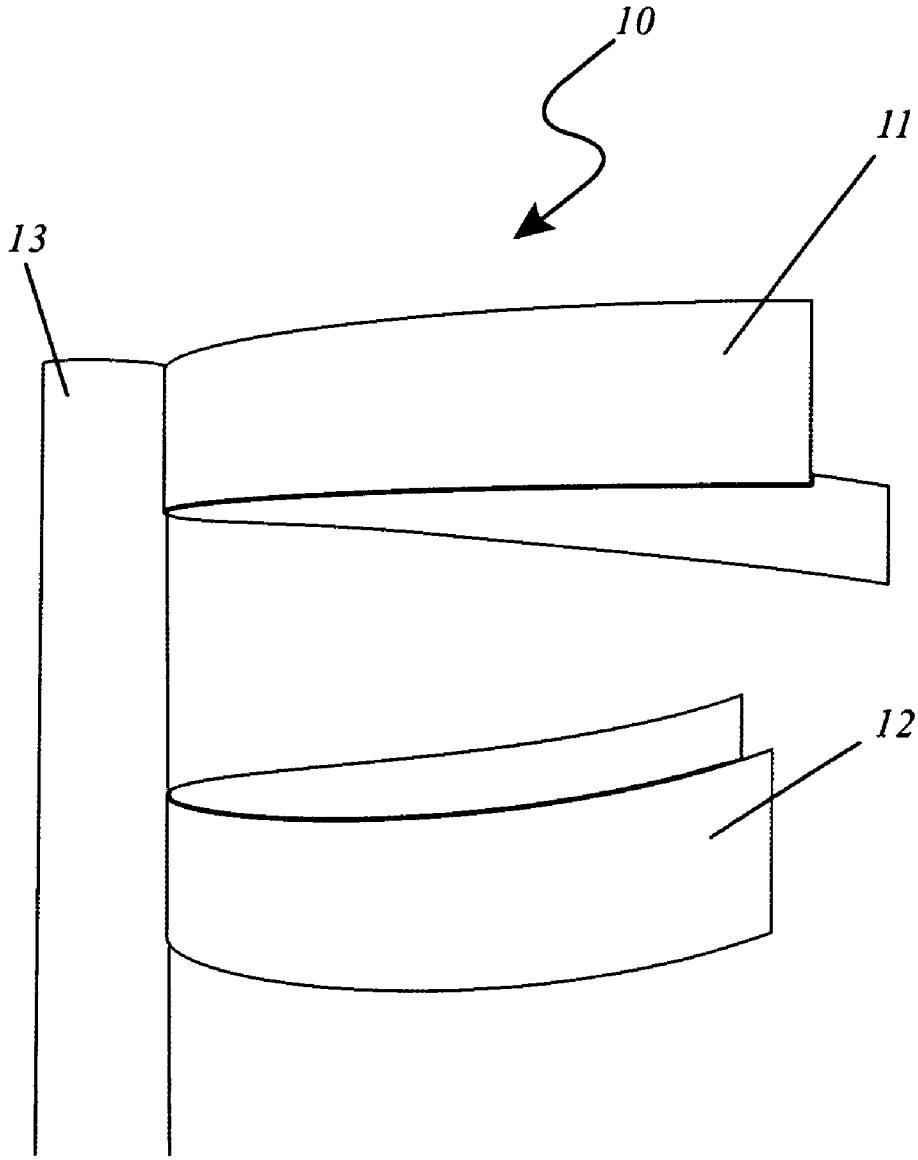
Figure 3:
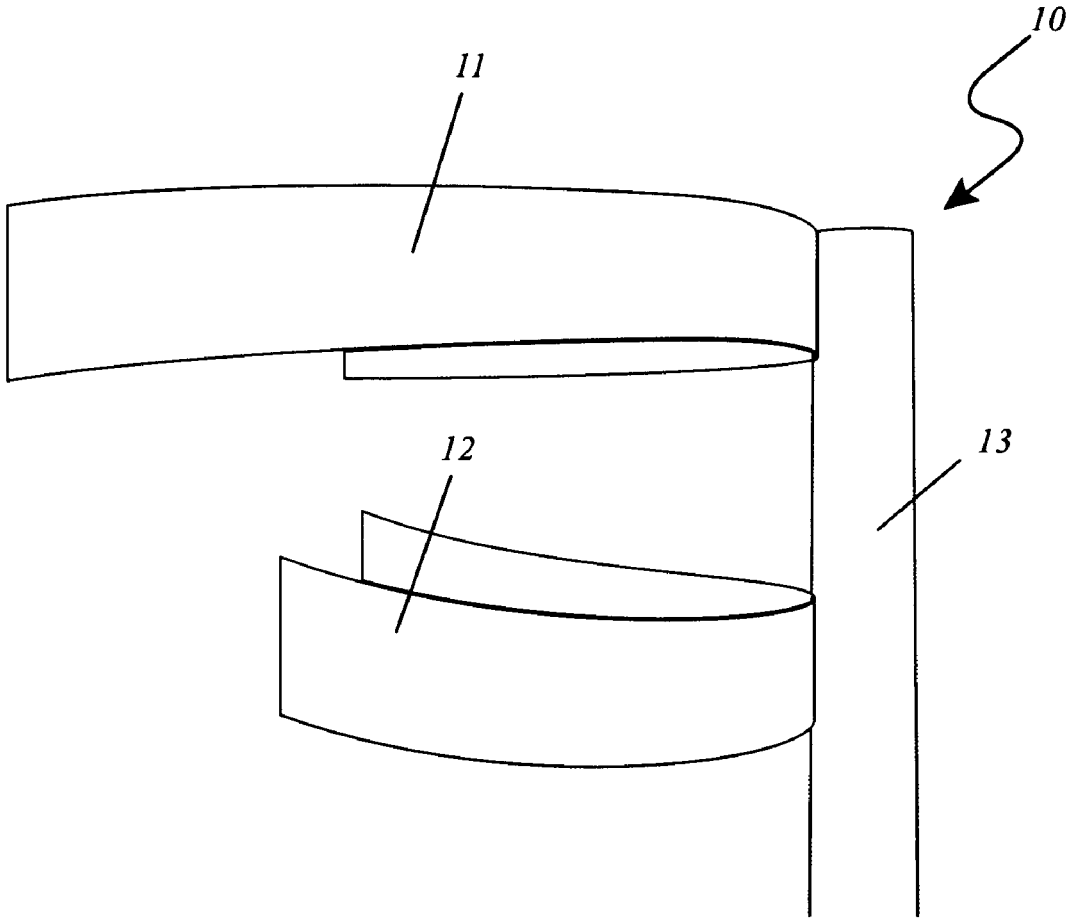
Figure 4:
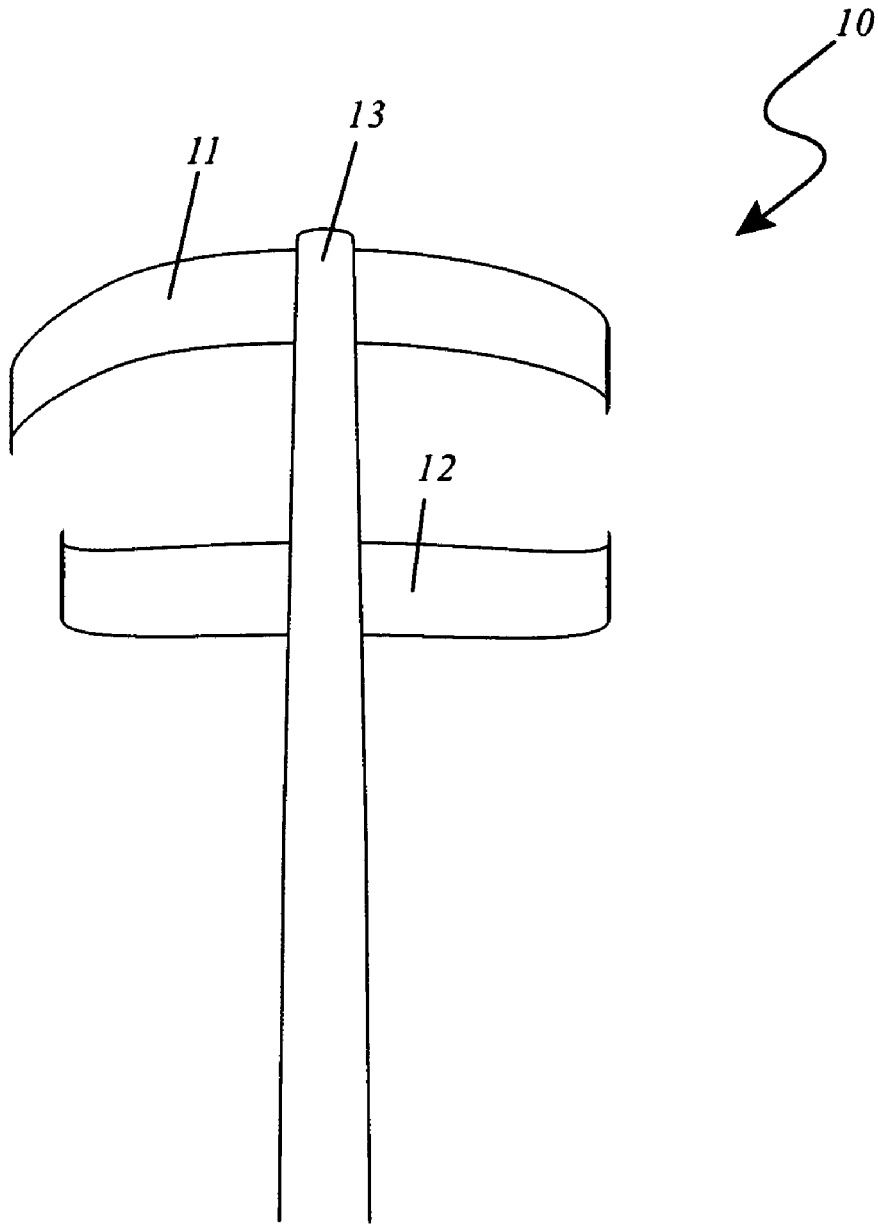

Referring now to FIGS. 1-4, the apparatus 10 takes the form of a golf swing training system 10. The head rest assembly consists of a removably attachable upper head rest 11 and an adjustably attachable lower head rest 12 generally comprised of plastic in an injection molding process or of steel in a stamping process and preferably padded. The removably attachable lower head rest 12 prevents the downward movement of the user's head while the golf club 20 is in the swinging motion. The padded cover of the head rests (upper 11 and lower 12) may be fabricated that of suitable textiles preferably by the use of sewing methods. As depicted in FIGS. 2-4, the upper head rest 11 may be in a shaped as half of a "C" to correspond with the user's forehead. The adjustably attachable lower head rest 12 is envisioned to be radially adjustable and designed to rest thereon a user's forehead compelling proper golf ball fixation before and during the event of swinging a golf club 20. The upper head rest 11 comprises of an attachable means by which would allow adjustments along the axis of the extendable shaft 13. The head rests (upper 11 and lower 12) may be adjusted to an appropriate height in accordance with the user preference and mounted thereto an extendable shaft 13. The configuration of the upper 11 and lower 12 head rests may be reversed to accommodate either a right-handed or left-handed golf club 20 swing.

The extendable shaft mechanism 13, comprising of steel or aluminum in an extrusion process with the possibility of minor machining, is designed to extend or retract in accordance with the user height. The extendable shaft mechanism 13 is designed to comprise of two (2) telescopically adjustable shafts, a base shaft and an adjustable shaft. The base shaft may comprise adjustment holes drilled therethrough adapted for receiving a projecting pin, extending perpendicularly outward from the face of an adjustable shaft thereof, so as to provide limited relative movement. A plurality of adjustment holes may be drilled therethrough in a variety of locations. The base shaft is envisioned to be a hollow open-ended tube to allow an extension member, such as an adjustable shaft, to be telescopically and/or rotatably disposed within the base shaft; although, the opposing end may be closed. Adjustable shaft inserts within one end of the base shaft extend outwardly at the distal end and are affixed into place via a projection pin locking in an adjustment hole. The adjustable shaft, consequently the head rests, may be radially adjusted utilizing the projection pin and adjustment hole arrangements. It is contemplated that the dimensions of the base shaft and adjustable shaft may vary.

Alternatively, the extendable shaft mechanism may be telescopically adjustable by other means such as, but not limited to, a base shaft having a tubular design that telescopically receives the adjustable shaft and secured in a desired position by one or a plurality of set screws.

Figure 5:
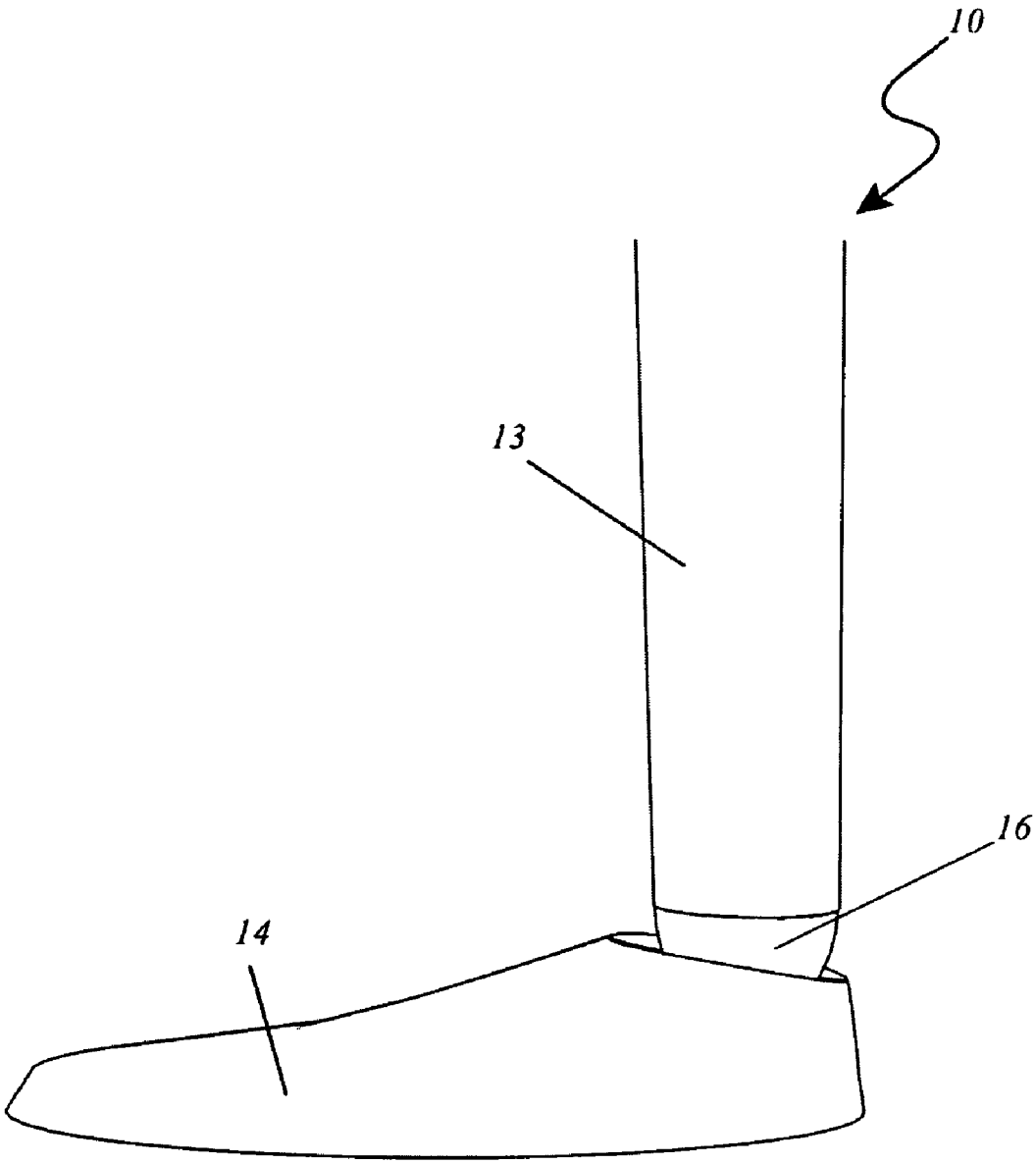

Referring now to FIG. 5, a side view of the shaft 13 attached therein the base plate 14, according to a preferred embodiment of the present invention, is disclosed. A rounded base of the extendable shaft mechanism 13 permits proper angular adjustments comprising of a user's height and positioning of the base plate 14. Improper angular adjustments, shifting of user's head before swinging for example, would promote the retraction of the apparatus 10, encouraging proper swinging technique. The rounded base 16 of the extendable shaft mechanism 13 is incorporated in a base plate 14.

The base plate foot assembly comprises of a base plate 14 possibly that in shape of a "T" to provide enhanced foundation of the apparatus 10. The base plate 14 is designed to station the apparatus 10 on various grade surfaces in addition to provide a means for attachment of the apparatus 10 via extendable shaft mechanism 13.

The preferred embodiment of the present invention is designed to be used by the common consumer with little or no special skills and minimum experience and training necessary. Likewise, golfers of various levels of experience and that of all ages can find this invention to greatly aid them in practicing and honing golf club swinging skills. When the device is first procured it should comprise of a headrest fabricated of plastic or steel and preferably padded, an extendable shaft 13 preferably fabricated that of durable material such as aluminum or steel, and a base plate 14 preferably fabricated that of aluminum or steel.

The method of utilizing the device may be achieved by performing the following steps: adjusting the head rests, upper 11 and lower 12, to the preferred axial placement; extending or retracting the extendable shaft 13 to desired length; placing the upper head rest 11 and the adjustably attachable lower head rest 12 in accordance with the user's forehead; placing the base plate 14 approximately six (6) inches outside of the swing path providing an outward angle therebetween user's forehead and the ground; acquiring proper swing stance; and, swinging golf club 20 with apparatus 10 detaching from user's forehead, if properly executed, after swinging.

The head rests (upper 11 and lower 12) provide immediate feedback of proper head movement. Proper head movement is depicted by the detachment of the apparatus 10 after swinging the golf club 20. Improper head movement occurs when the detachment of the apparatus 10 occurs before or during the event of the swinging of a golf club 20. Improper angular adjustments, such as the shifting of the user's head before swinging, would promote the retraction of the apparatus 10. Maintaining the stability of the device 10 in its extended state promotes and encourages proper swinging technique.

An additional embodiment of the present invention may provide for anchoring means for the base plate. This provides additional stability for the entire device and may come in the form of removable spikes that penetrate a ground surface or resilient hardware within a hard surface in a training facility or similar location.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A golf swing alignment training device comprising:

a "C"-shaped head supporting member, further comprising a central post with an upper head rest and a lower head rest attached thereto, both said upper and lower head rests capable of radial adjustments;

a telescoping pole assembly attached at its upper end to a bottom end of said central post and comprising height adjustment securing means, said telescoping pole assembly comprising a hollow bottom tube and an extendable upper tube; and, a base plate connected to a bottom end of said telescoping pole assembly via a pivoting connection;

wherein said upper and lower head rests are spaced apart and extend along mutually exclusive semi-circular paths respectively, each of said semi-circular paths being registered orthogonal to a longitudinal length of said central post;

wherein said upper and lower head rests are statically coupled directly to said central post and are configured in such a manner that said upper and lower head rests remain vertically juxtaposed along the longitudinal length of said central post during a golf swing.

2. The device in claim 1, further comprising anchoring means for anchoring said base plate to a ground surface.

3. The device in claim 1, wherein said lower head rest is removably attachable to said central post via a clamping mechanism.

4. The device in claim 1, further comprising a lightweight and resilient material of construction.

5. The device of claim 1, wherein said pivoting connection further comprises:

said bottom end of said telescoping pole assembly comprises a rounded end of said hollow bottom tube;

said base plate has a receiving aperture for receiving said rounded end of said hollow bottom tube.

6. A proper golfing hitting stance training method, comprising the steps of: providing a device comprising:

a "C"-shaped head supporting member, further comprising a central post with an upper head rest and a lower head rest attached thereto, both said upper and lower head rests capable of radial adjustments;

a telescoping pole assembly attached at its upper end to a bottom end of said central post and comprising height adjustment securing means, said telescoping pole assembly comprising a hollow bottom tube and an extendable upper tube; and, a base plate connected to a bottom end of said telescoping pole assembly via a pivoting connection;

wherein said upper and lower head rests are spaced apart and extend along mutually exclusive semi-circular paths respectively, each of said semi-circular paths being registered orthogonal to a longitudinal length of said central post;

wherein said upper and lower head rests are statically coupled directly to said central post and are configured in such a manner that said upper and lower head rests remain vertically juxtaposed along the longitudinal length of said central post during a golf swing;

positioning a user into a proper golf stance;

placing a user's head into said head supporting member by placing the crown of one's head in said upper head rest and the forehead of one's head in said lower head rest;

placing said base plate on a ground surface directly in front of the user and at a distance outside an intended swing path;

adjusting said telescoping pole assembly by extending or retracting said extendable upper tube within said hollow bottom tube according to a desired height and securing said desired height of said telescoping pole assembly with said height adjustment securing means;

maintaining said proper golf stance with said user's head within said head supporting member, said act trains the user to focus their eyes on a golf ball, said telescoping pole assembly properly adjusted to said height, and said base plate contacting said ground surface;

performing a proper golf swing comprising maintaining said user's head within said head supporting member and said base plate pivots with the user during said golf swing via said pivoting connection thereby maintaining proper golf swing, wherein said device remains attached to said user's head and does not fall away;

repeating the above method if said device falls away due to an improper golf swing; and, removing said user's head from said head supporting member, releasing said height adjustment securing means, retracting said telescoping pole assembly into a collapsed position, and storing said device for later use.

7. The method of claim 6, further comprising the step of anchoring said base plate to said ground surface.

8. The method of claim 6, further comprising the step of attaching or removing said lower head rest from said central post of said head supporting member if desired.

* * * * *